US011713158B2

(12) United States Patent
Gulick et al.

(10) Patent No.: US 11,713,158 B2
(45) Date of Patent: Aug. 1, 2023

(54) REUSABLE POUR SPOUT SYSTEM AND METHOD

(71) Applicant: Matthew Allen Gulick, Savannnah, GA (US)

(72) Inventors: Matthew Allen Gulick, Savannah, GA (US); Paul R. Metcalfe, Solon, OH (US)

( * ) Notice: Subject to any disclaimer, the term of this patent is extended or adjusted under 35 U.S.C. 154(b) by 0 days.

(21) Appl. No.: 17/483,211

(22) Filed: Sep. 23, 2021

(65) Prior Publication Data

US 2023/0088750 A1 Mar. 23, 2023

(51) Int. Cl.
*B65D 5/74* (2006.01)
*B65D 51/22* (2006.01)
*B65D 47/36* (2006.01)

(52) U.S. Cl.
CPC ..... *B65D 5/747* (2013.01); *B65D 47/36* (2013.01); *B65D 51/222* (2013.01); *B65D 2251/0028* (2013.01); *B65D 2251/0087* (2013.01)

(58) Field of Classification Search
CPC ..... B65D 5/747; B65D 47/36; B65D 51/222; B65D 2251/0028; B65D 2251/0087
USPC ..... 222/478, 556–570, 92–107, 80–91, 256; 229/200, 204, 210, 213–215, 247, 248; 393/80
See application file for complete search history.

(56) References Cited

U.S. PATENT DOCUMENTS

| | | | | |
|---|---|---|---|---|
| 1,309,167 | A * | 7/1919 | Wyatt | B67B 7/26 222/90 |
| 2,687,158 | A * | 8/1954 | Owen | B65D 75/5877 206/521 |
| 2,782,967 | A * | 2/1957 | Walker | B65D 47/065 222/536 |
| 10,479,568 | B2 | 11/2019 | Carlson et al. | |
| 10,718,692 | B2 * | 7/2020 | Later | G01N 1/2273 |
| 11,077,992 | B2 | 8/2021 | Kerstetter et al. | |
| 2003/0126843 | A1 * | 7/2003 | Hsu | B01D 46/10 55/385.4 |
| 2008/0210707 | A1 | 9/2008 | Kitai | |

* cited by examiner

*Primary Examiner* — Lien M Ngo
(74) *Attorney, Agent, or Firm* — Law Offices of John G. Posa

(57) ABSTRACT

A reusable pour spout system that may be attached to different container types to dispense different substances, including course and fine granular materials and liquids. A port component has a proximal tubular end and a flange that is larger than the tubular end. The flange further includes a hole-cutting structure adapted to pierce the wall of a container, with a cutting edge adapted to form a hole in the container when the port component is rotated by a user after piercing. This positions the flange within the container with the tubular end exposed to receive a nut that traps the wall of the container between the nut and the flange. A cap is provided to seal off the port. The tubular end of the port component, the nut, and the cap may all be threaded. Different structures to enhance cutting and sealing are disclosed along with preferred method steps.

14 Claims, 10 Drawing Sheets

X = Potential Spout Placement

REUSABLE POUR SPOUT SYSTEM AND METHOD

FIELD OF THE INVENTION

This invention relates generally to container spouts and, in particular, to a reusable system adapted for attachment to bags and other containers for granular and other flowable materials.

BACKGROUND OF THE INVENTION

There are various resealing devices on the market today for liquids, but in the case of bags containing perishable foods such as cereal, rice, beans, seeds, pet food, as well as non-edible materials such as fertilizer, dog/cat litter, and so forth, the options are severely limited. When containers for such materials are opened in the traditional manner—usually cutting or ripping open the top—the problems associated with resealing become evident.

A few devices exist, such as clothes pegs and clamps, and in the case of plastic bags there exist portable heat-sealers and also bag 'neck' sealing devices. However, these latter devices technically reseal the bag permanently and the former devices do not guarantee an airtight seal. Air-tightness becomes important when considering the condition of the material inside. Organic material such as pet-food begins to lose its nutritional value when exposed to air, including the issue of fungus development.

Food may be decanted into containers but in the case of plastic, unless the plastic is FDA approved, issues exist wherein inferior plastics leech into the food. Even with FDA approved plastics there is a need to thoroughly wash the container between refilling as decaying food adheres in microscopic form to the sides of the container, which may accelerate the degradation of the materials. Metal bins may not be any better, as some may contain heavy metals such as lead which can lead to heavy metal poisoning.

Research from pet-food companies and elsewhere shows that the original container (i.e., the case, bag or sack as purchased) remains the most effective place to leave pet food. This is probably the case with a number of other organic and possibly non-organic materials that can be decanted through the device.

Despite existing closure mechanisms, however, there remains a lack of a reusable device that can open and reseal a container in the least intrusive way. Furthermore, there is a lack of devices with the ability to make an airtight and in some cases watertight seal, so that the contents of the container retain their 'freshness' for the longest period of time.

SUMMARY OF THE INVENTION

This invention improves upon the existing art by providing a pour spout system that may be attached to many different container types to dispense many different substances, including course and fine granular materials and liquids. The system may be attached in virtually any convenient location on bags and other flexible packaging, as well as semi-rigid or rigid containers depending upon wall material, thickness or other factors. In all embodiments, the pour spout system may be removed and reused.

A pour spout system constructed in accordance with the invention includes a port component having a proximal tubular end, a distal end with a flange, and a through bore. The proximal tubular end and bore may be cylindrical, and the flange may be circular or cylindrical as well. The flange of the port component includes a proximal surface that is larger than the diameter of the proximal tubular end of the port component. The flange further includes a hole-cutting structure adapted to pierce the wall of a container, with a cutting edge adapted to form a hole in the container when the port component is rotated by a user after piercing. The flange may include a gap with a ramp through which container material advances as the port component is rotated until the flange is fully within the container. The cutting edge may be integrally formed with the port component or may form part of a separate blade.

Following the formation of the hole in the container, the flange is within the container, and the hole cut in the container is aligned with the through bore. The proximal end of the port component is configured to receive a nut that traps the wall of the container between the nut and the flange when tightened by a user, and a cap is provided to seal off the through bore. In a preferred embodiment, the proximal tubular end of the port component, the nut, and the cap are all threaded, though bayonet, magnetic and other coupling mechanisms may be used.

The cap may include a proximal end with a user-operated aperture through which the contents of the container are poured. The aperture may be adjustable, from an open condition to a closed, sealed condition, and may include a pouring trough in communication with the aperture. The proximal end of the cap, with or without that aperture, may include an inner surface with an axial protrusion that pierces the container to assist with centering the cut in the container. The system may further include one or more compressible, resilient seals, and the cap may be sized or marked for use as a measuring cup.

A method of attaching a pour spout to a container having a wall with inner and outer surfaces, comprising the steps of:

choosing a location on the container to attach a pour spout;

providing the pour spout system of claim 1;

piercing the container with the hole-cutting structure of the port component at the chosen location;

rotating the port component until the flange of the port component faces the inner surface of the container wall;

installing the nut onto the port component so that the container wall is trapped between the nut and the flange of the port component; and installing the nut onto the port component to seal off the pour spout.

The method may further include the steps of removing the cap, nut and port component for reuse.

DETAILED DESCRIPTION OF THE PREFERRED EMBODIMENTS

Figure 1A:
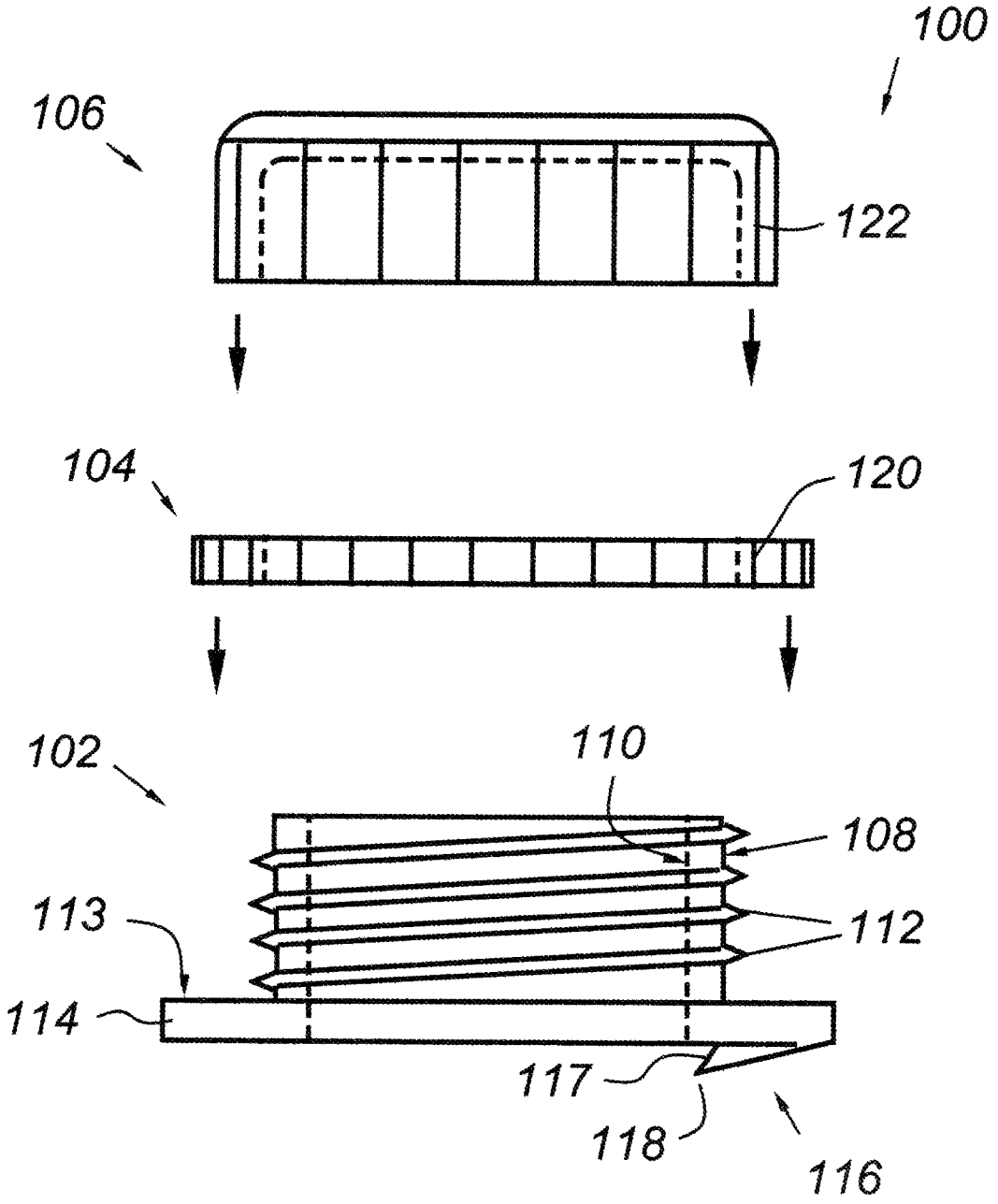
FIG. 1A is an exploded view of a basic embodiment of the invention illustrating important components.
Figure 1B:
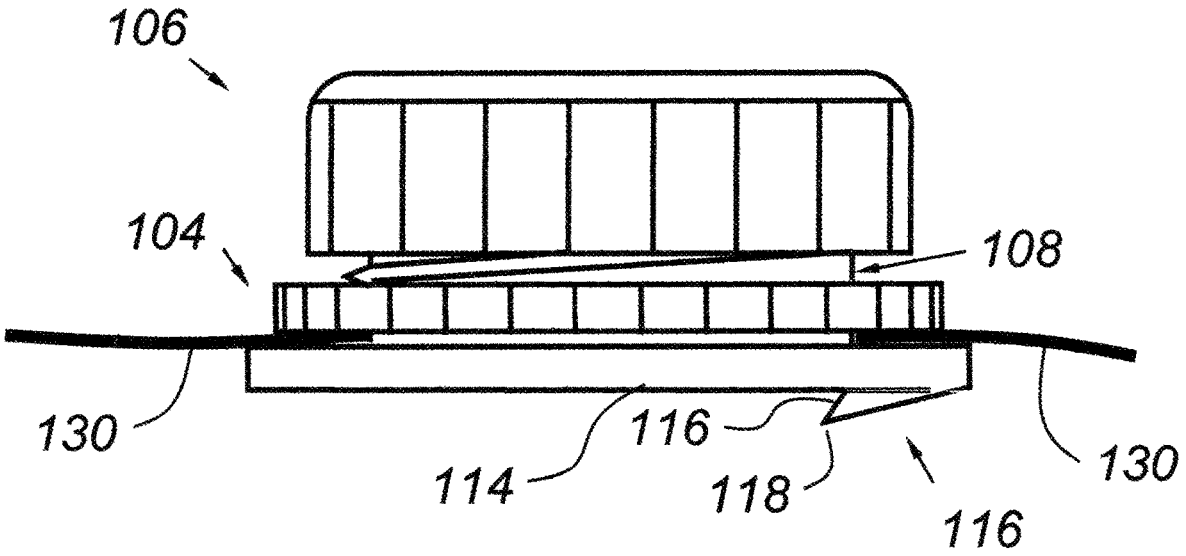
FIG. 1B shows the components of FIG. 1A in an assembled state.

Now making reference to the accompanying drawings, FIG. 1A depicts a simplified, exploded view of the invention at 100 prior to installation onto a container, and FIG. 1B shows the assembly of FIG. 1A in an installed condition. It is important to point out that FIGS. 1A, B are for introductory purposes only, and leave out details about certain features and alternative embodiments described in further detail below.

The invention comprises three primary components; namely, a port component 102, a nut 104, and a cap 106. Some embodiments may include additional components, but all embodiments at least include components 102, 104, 106. Components 102, 104, 106 may be constructed of any durable, rigid or semi-rigid materials, though in the preferred embodiments all are made from injected molded plastic such as polypropylene, polyethylene, polystyrene, nylon, vinyl, or the like. Food-grade materials are preferred for food-contact applications. The components may be any color.

Port component 102 includes a proximal, tubular end having an inside diameter (I.D.) 110, an outside diameter (O.D.) 108, and threads 112. The invention may cover a range of diameters depending upon the material(s) to be dispensed. The invention is not limited to solid materials, and may be used with liquids, particularly if appropriate seals are used (i.e., O-rings). For example, I.D.s of less than an inch are possible for readily flowable or fine-grained materials, whereas, for larger granular solids, the I.D. may be in the range of 3"-6". For most applications, the I.D. is in the range of 1"-3", more preferably about 2-2.5". The O.D would of course vary with the I.D. to maintain a reasonable wall thickness "W" and ease of fabrication.

The port component 102 further includes an integrally molded flange 114 with any appropriate thickness. The flange is preferably generally round, with a diameter greater than O.D. 108, and is more closely matched to the diameter of nut 104. In the preferred embodiments, the flange 114 includes a proximal surface with a flat land 113 to better trap container material as explained with reference to FIG. 1B. "Flat," however, would not preclude possible forms of surface roughing of land surface 113 such as stippling, serrations, etc., to increase friction. The same holds true for the bottom surface of nut 104.

The flange of the port component 102 further includes a distally extending structure 116 with a cutting edge 117. As explained with reference to installation steps described herein, this structure is used to penetrate the container and form a hole in the wall of the container as the flange component 102 is rotated. As such, the structure 116 preferably includes a pointed distal end 118 to penetrate the container wall to initiate the cutting process.

The cutting edge (and penetrating end) may be integrally formed with the port component, particularly if fabricated from a hard material such as polycarbonate. In the preferred embodiments, however, at least the cutting edge is made of a different material such as stainless steel or other metal and added to the port component as insert-molded, i.e., molded-over in injection molding or casting, or with one or more rivet fasteners or the like, or with melted posts, etc. As a further alternative, at least the cutting edge may be removable and replaceable using one or more threaded fasteners, for example.

Both the nut 104 and cap 106 preferably have threads that match the threads of the port component 102. In the preferred embodiment all threads are right-handed. The nut may be of any thickness to maintain desired rigidity, and one or both of the nut and cap may include outer surfaces with flutes 120, 122 or other structures to enhance gripping. As an alternative to the cap making a threaded connection, other closure mechanisms may be used such as bayonet fittings or the like. Further, magnets can be used for holding the cap onto port (with no thread or bayonet) as attracting pairs or with ferric material on one side and magnet opposite. The degree of hold can be dictated by magnet field strength and quantity used. Rotating to release and pull off a cap similar to the bayonet function would be a desirable yet simple functional alternative.

The interior of the cap may also be of a predetermined size and/or include markings enabling the cap to be used as a measuring cup. For example, the cap may hold a half cup (or other amount) of material when fully filled, or markings within the cap may show volume (or approximate weight).

FIG. 1B is a drawing that shows the simplified assembly of FIG. 1A attached to a container. The wall of the container is shown at 130. Note that edges of the hole cut into the container extend all the way up to the outer diameter 108 of the port component 102. Indeed, with some configurations, the hole may be slightly smaller than O.D. 108, such that the container material curls slightly against the O.D. for an enhanced seal. But importantly, in all embodiments, as the port component is rotated and the cutting edge cuts the container, the flange progresses through the hole, with land surface 133 positioned against the inner surface of container wall 130. As such, when nut 104 is tightened, the wall 130 of the container is trapped between the flange 114 and washer for a tight seal, including a water- or air-tight seal depending upon tolerances, the use of O-rings, and so forth.

The invention may be installed in any convenient location on a bag or other container. Once a location in selected, a user pierces the container with the cutter structure on the distal end of the port component and turns the port component until a hole is cut into the container material. The port component is preferably turned in clockwise direction. Once the hole is cut, the cutout material may be removed from the port component. In the event that a portion of the cutout remains intact or falls into the container, the invention will operate successfully nevertheless.

Figure 2:
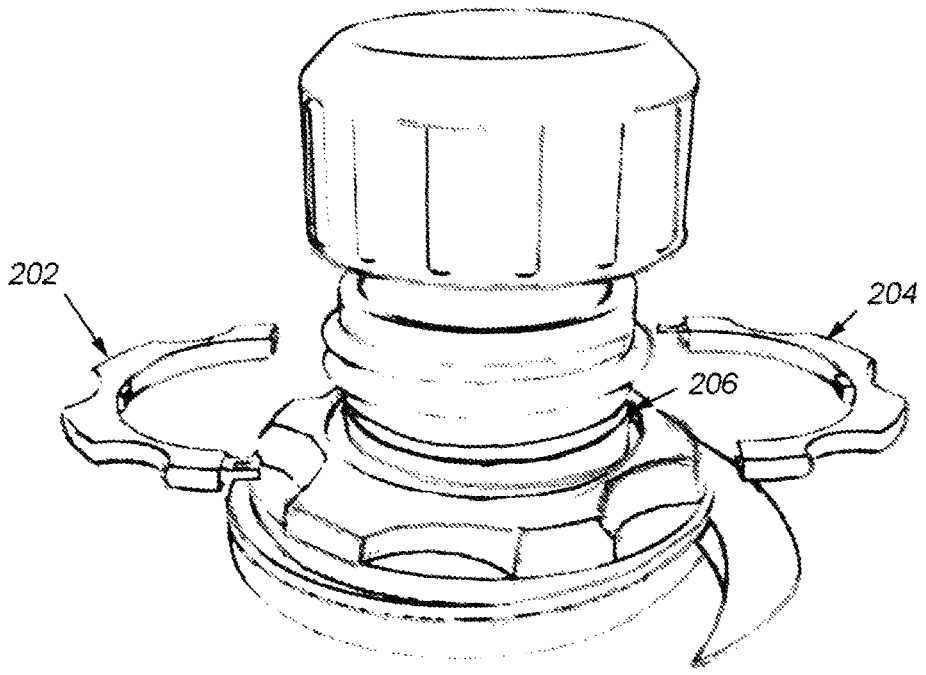
FIG. 2 is a perspective view of an embodiment of the invention using a multi-part, snap-on grip for turning.

Different devices and techniques may be used to rotate the port component and center the cut that will now be described. To rotate the port component, a user may simply grasp the threaded end of the component and rotate it. As a first alternative, the invention may include the multi-part thumb grip shown in FIG. 2. In this embodiment, two parts 202, 204 are assembled onto a relief 206 in the threaded end of the port component. Once assembled, the thumb grip rotates with the port component, enabling a user to more easily rotate the component relative to the container. In the preferred embodiment, however, it has been found that a user may simply install the cap onto the threaded end and use the cap to rotate the port component. Once the nut is tightened, the cap may be removed as needed to pour the contents of the container.

Figure 3:
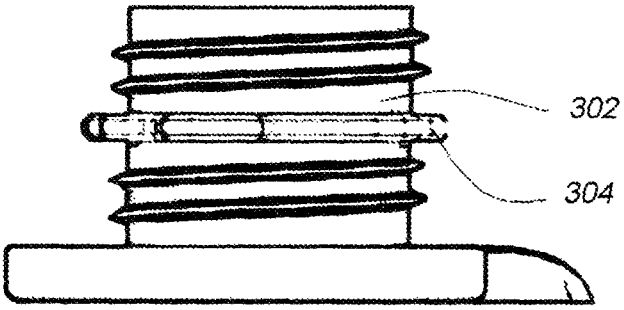
FIG. 3 is a side view of the grip in position.
Figure 4:
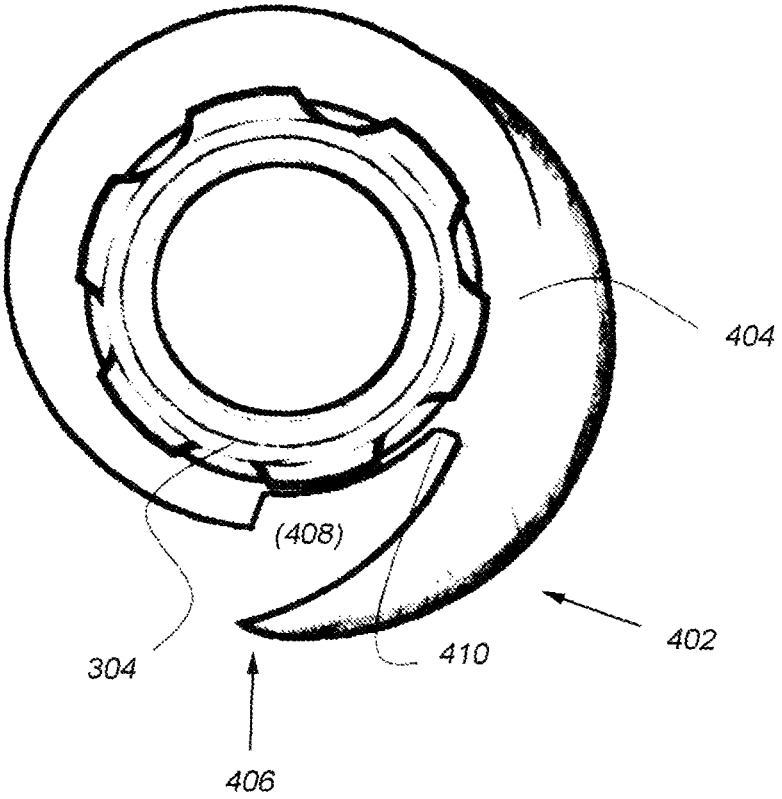
FIG. 4 is a drawing that shows one style of container cutting structure.
Figure 5A:
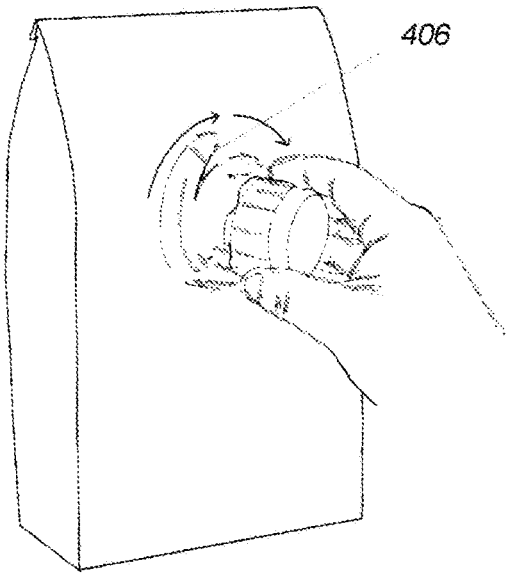
FIG. 5A is a first drawing of a sequence that shows how the inventive spout is installed onto a flexible container.
Figure 5B:
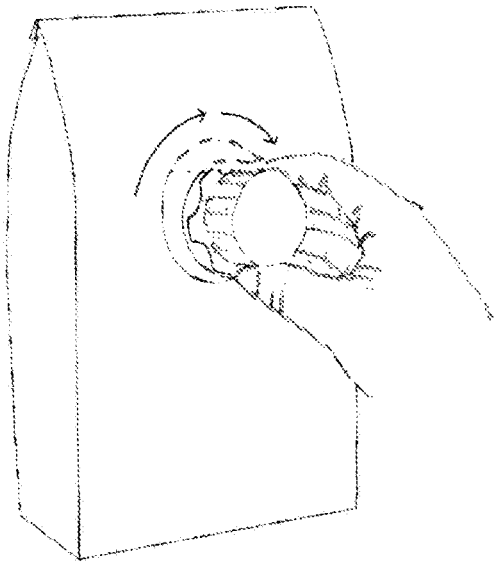
FIG. 5B continues the sequence of FIG. 5A.
Figure 5C:
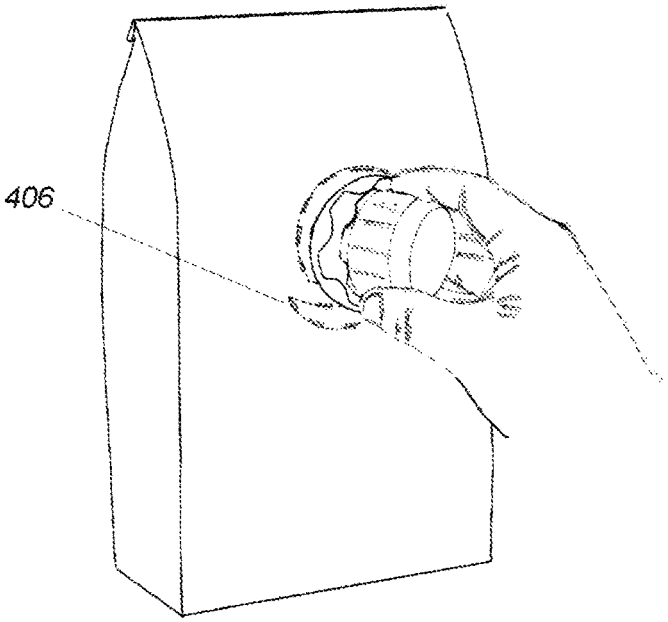
FIG. 5C nearly completes the sequence of FIG. 5A.

FIG. 3 shows the thumb grip assembled onto the threads of a port component 302. The grip 304 may be disassembled prior to installation of the nut after cutting the hole, or the nut may be loosely held onto the threaded end during the cut. FIG. 4 is a top-down view of the embodiment of FIG. 3, also showing one version of a cutting structure, in this case a "crab-claw" design 402. The flange, shown at 404, includes a pointed tip 406, leading to a gap 408 terminating in a cutting edge 410. In this case a user pierces that container with point 406 and cuts the hole as the port component is rotated. FIGS. 5A-C show a user piercing and rotating a port component according to the invention.

Figure 6:
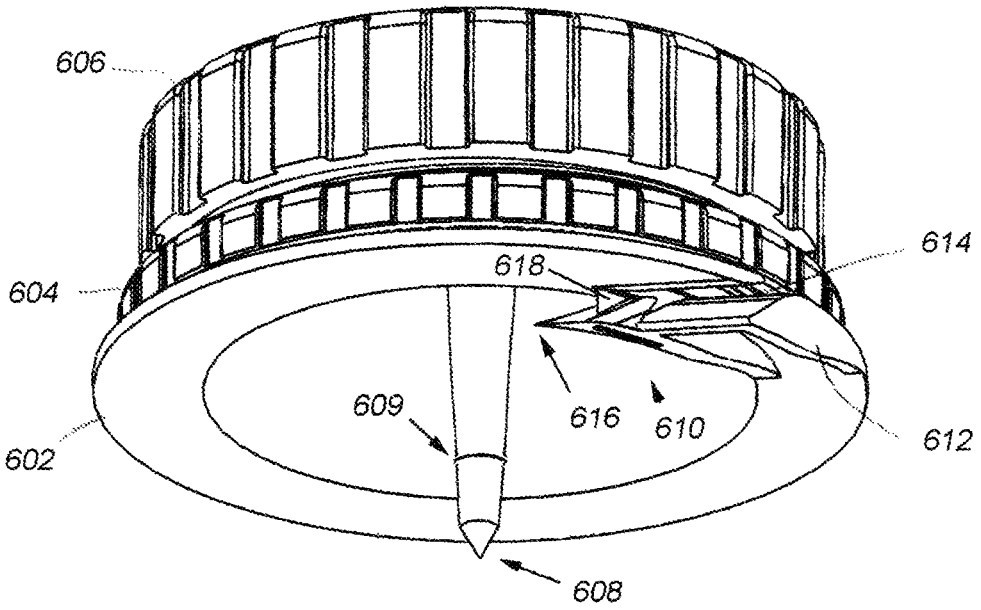
FIG. 6 shows how a cap may include a distally oriented pin used to center the a cutting operation.
Figure 7:
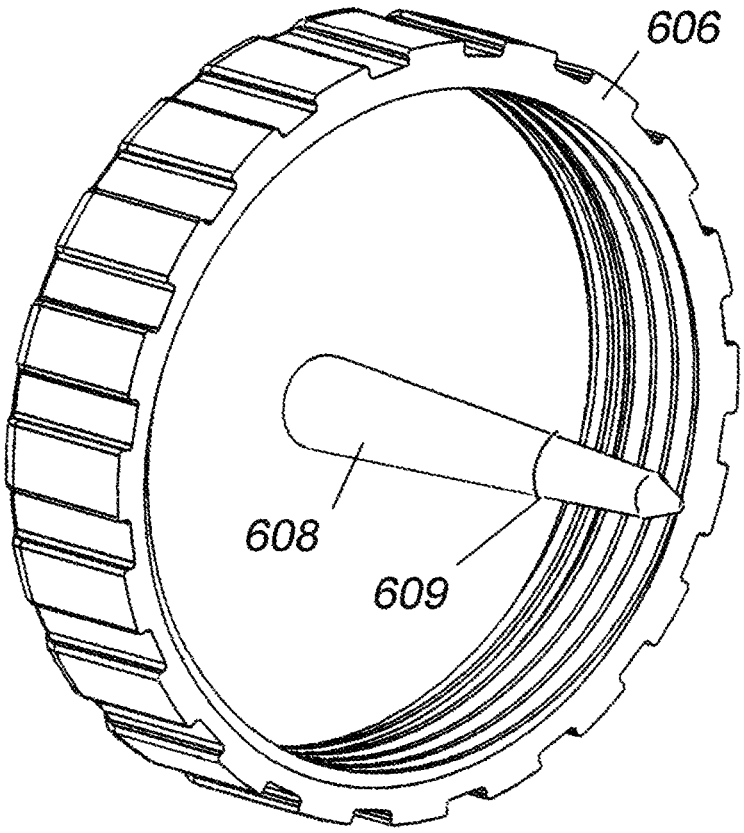
FIG. 7 is an oblique view showing a centering pin, preferably integrally molded into a cap 606.
Figure 8:
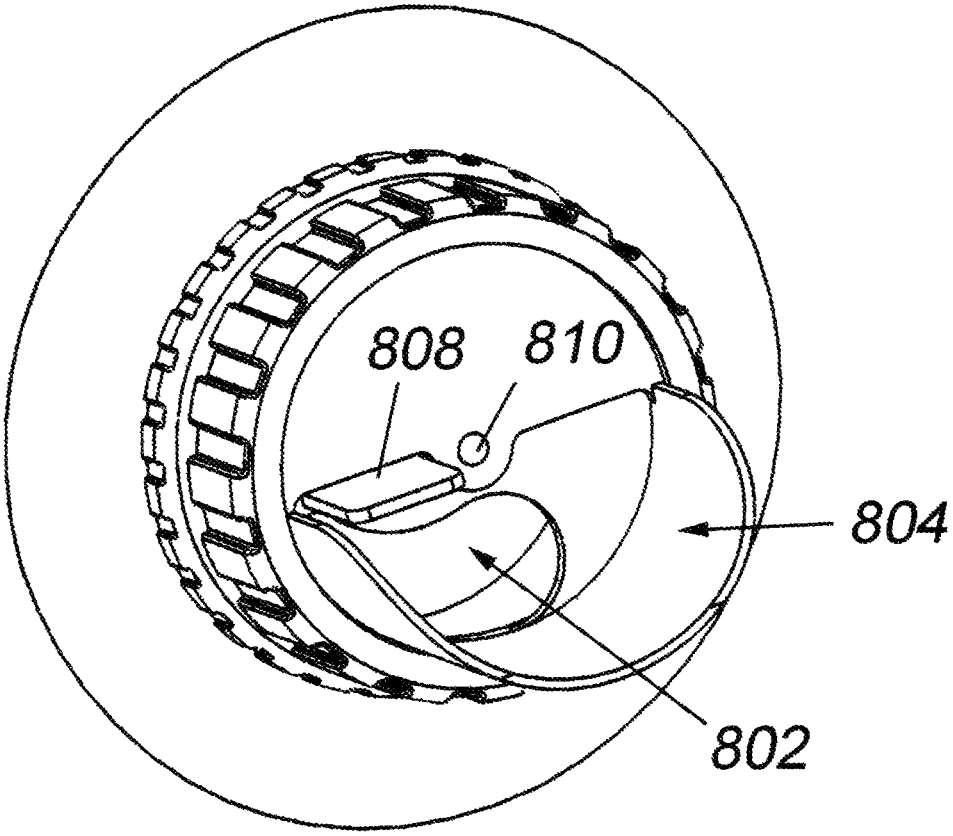
FIG. 8 depicts a further alternative wherein the proximal end of the cap is replaced with an adjustable aperture and pouting trough.

FIGS. 6, 7, 8 illustrate alternative aspects of the invention. For example, FIG. 6 shows a different cutting assembly 610, including a ramp structure 612 that leads to a gap 614. The container material is pierced with point 616 and an axially oriented cutting blade 618.

FIG. 6 also shows how the cap 606 may include a distally oriented pin 608 used to center the assembly during the cutting operation. FIG. 7 is an oblique view showing pin 608, preferably integrally molded into cap 606. The "point" of the pin 608 may have any appropriate degree of sharpness.

FIG. 8 depicts a further alternative wherein the proximal end of the cap is replaced with an adjustable aperture 802 and pouring trough 804. This arrangement enables a more controlled dispensing of smaller granular contents. In operation, tab 808 would be incrementally moved from a fully closed to open position. In FIG. 8, aperture 802 is about halfway open. Item 810 shows where a centering pin like pin 608 could be located.

Figure 9:
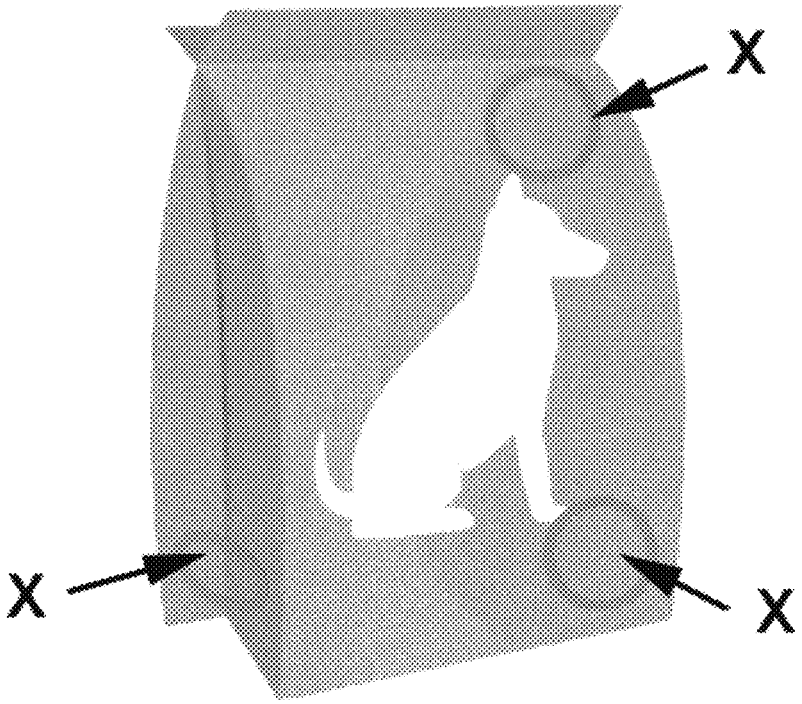
FIG. 9 shows various possibilities for locating the inventive spout depending upon weight, whether the container will be on a raised platform, and other factors associated with container contents and use.

Regardless of the embodiment, the user first determines where on the container the reusable spout should be installed. FIG. 9 shows various possibilities for locating the device, depending upon weight, whether the container will be on a raised platform, and other factors associated with container contents and use.

Making reference to FIG. 6, prior installation, cap 606 would be tightened down completely to enable clockwise torque required for the cutting operation. The cap is the mechanical handle of sorts to install into a bag/container. Nut 604 may be backed off as far as possible from the flange 602 to offer space for the bag/container material to ride into the space between nut 604 and flange 602.

Having located the center of installation, the user would push the piercing/cut guide centering pin integral to either the cap or the aperture plate version through the bag/container. The entire assembly would then be rotated clockwise so the piercing point 616 in front of the blade 618 pierces and cut the material during rotation. The ramp 612 behind the piercing point 616 guides the container material up to the blade for cutting. The piercing pin 608 acts as the center for the "compass-action" cutting.

The process continues, pushing lightly while rotating clockwise until the blade cuts a complete circle from the bag/container and the flange 602 is entirely inside the container and bag/container material is sandwiched between the flange 602 and nut 604. The nut 604 is then tightened onto the bag/container material, enabling sealing and mechanical securement. The cap is then rotated counterclockwise to remove it, and the circular cutout of the bag/container will be stuck onto the piercing pin by way of a) the tapered shaft and or b) the barbed male or female ring or rings 609 that act as mechanical grips to hold the bag cutout until it is discarded. The cap may then be reinstalled and tightened securely to seal the container assembly. If the adjustable aperture is used it would be closed to seal the port.

When material is ready to be dispensed from the bag/container, the cap is removed (or the cap is loosened and the aperture plates are adjusted to the desired size and pour). The spout is closed by reinstalling the cap or closing aperture and tightening the cap. If the user wishes to expel air inside the bag, the cap or aperture plates may be left open and the bag/container may be squeezed or rolled, etc. to remove excess air, then resealed to keep contents fresher for pet food and other applications.

As a further option, the cap may incorporate a one-way valve (i.e., flap, bicuspid, tricuspid) such that air may be expelled without being sucked back in. If further air degradation mitigation is desired for particular applications, a vacuum supply may be connected to a port in the cap (not shown) to create vacuum pressure in the bag/container or positive pressure with a selective pressurized gas or liquid that can protect and or react with internal contents via the convenience of the spout system.

Figure 10:
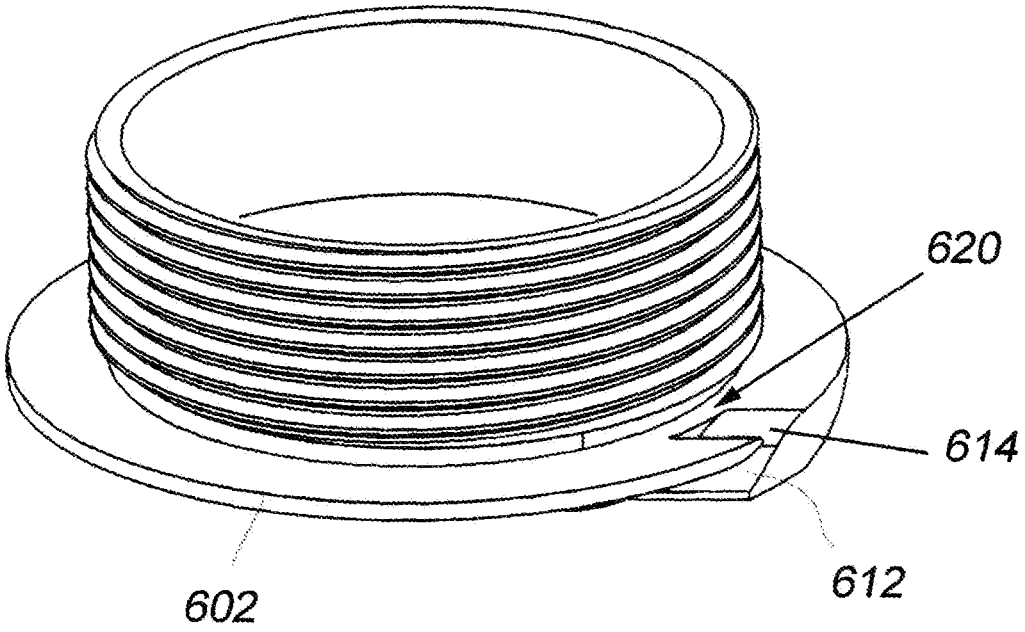
FIG. 10 is a perspective view of a port component showing how at least a portion of the flange extends circumferentially all the way around the threaded end for a tighter seal.

It should be apparent that a goal of the invention is to seal and reseal the bag/container as tightly as possible between uses. FIG. 10 is a perspective view of a port component showing how at least a portion of the flange extends circumferentially all the way around the threaded end, including a small land portion 620 between the threaded tube and gap 614 that transitions to ramp 612. This is in contrast to the "crab claw" design that featured a much larger gap. With the configuration of FIG. 10, particularly if O-ring(s) are used between the nut and flange, a comprehensive seal may be achieved.

As an alternative to sealing with O-rings, two opposing lobes on the nut may be used to facially seal and offer mechanical grip on the bag/container material pressed against the flat face of the flange. These lobes can either be over-molded rubber or rigid with the use of a rubber washer of sorts on the flat face flange. The inside or smallest diameter rib or lobe on the nut can ride and seal on the continuous surface 620. The seal between the cap and the flange end can be facial of the two flat surfaces coming together in the depth of the cap with a resilient rubber washer in the cap, alternatively, overmolded rubber in the cap or similar arrangements where rigid and soft materials make a seal depending on the degree of sealing or airtightness desired.

To remove the spout system from a container for re-use, the installation sequences described above are essentially carried out in reverse order. That is, the cap is removed, the nut is removed, and the port component is pulled out of the container. In contrast to installation, the port component need not be "unscrewed" since, presumably the bag or other container is empty and need not be physically preserved.

The invention finds utility in a wide range of applications. Originally intended to seal a variety of flexible containers, if a hole is drilled or cut with saw or knife the invention may be of great value for a variety of rigid or semi-rigid containers. In some circumstances, the packaging informational hang tag for retail display or merchandising may be used as a hole template where it may be conveniently installed between the nut and port's flange. Candidate uses include at least the following:

Pet Foods,

Plastic pellets for injection molding (i.e., 50 pound bags),

Fertilizers,
Tile mortar, grout, concrete, etc.,
Flour,
Sugar,
Cereals and Grains,
Hops,
Pool chemicals,
Coffee beans ground or unground,
Liquids,
Others.

The invention claimed is:

1. A pour spout system adapted for use with a container having a wall, the system comprising:

a port component having a proximal tubular end having a diameter, a distal end with a flange, and a through bore extending between the proximal and distal ends;

wherein the flange of the port component defines an outer periphery that is larger than the diameter of the proximal tubular end;

the flange including a hole-cutting structure adapted to pierce the wall of a container and a cutting edge adapted to form a hole in the container when the port component is rotated by a user after piercing;

wherein, following the formation of the hole in the container, the flange is within the container and the hole cut in the container is aligned with the through bore;

wherein the proximal end of the port component is configured to receive a nut that traps the wall of the container between the nut and the flange when tightened by a user; and a cap configured to seal off the through bore.

2. The pour spout system of claim 1, wherein the proximal tubular end of the port component, the nut, and the cap are all threaded.

3. The pour spout system of claim 1, wherein the cap has a user-adjustable aperture through which the contents of the container are poured.

4. The pour spout system of claim 3, wherein the aperture is adjustable from an open condition to a closed, sealed condition.

5. The pour spout system of claim 3, including a pouring trough in communication with the user-adjustable aperture.

6. The pour spout system of claim 1, wherein the cap has an inner surface including an axial protrusion that pierces the container to assist with centering the cut in the container.

7. The pour spout system of claim 1, wherein the flange of the port component includes a gap with a ramp through which container material advances as the port component is rotated until the flange is fully within the container.

8. The pour spout system of claim 1, further including a compressible, resilient seal between the flange and the wall of the container, the nut and the wall of the container, or on both sides of the wall of the container.

9. The pour spout system of claim 1, wherein the cap includes a compressible, resilient seal.

10. The pour spout system of claim 1, wherein the cap is sized or marked for use as a measuring cup.

11. The pour spout system of claim 1, wherein the cutting edge is integrally formed with the port component or utilizes a separate blade.

12. A method of attaching a pour spout to a container having a wall with inner and outer surfaces, comprising the steps of:

choosing a location on the container to attach a pour spout;

providing the pour spout system of claim 1;

piercing the container with the hole-cutting structure of the port component at the chosen location;

rotating the port component until the flange of the port component faces the inner surface of the container wall;

installing the nut onto the port component so that the container wall is trapped between the nut and the flange of the port component; and installing the cap onto the port component to seal off the pour spout.

13. The method of claim 12, including the steps of removing the cap, nut and port component for reuse.

14. The pour spout system of claim 1, wherein the port component, nut and cap are molded plastic pieces.

* * * * *